United States Patent [19]

Skees

[11] 4,234,213

[45] Nov. 18, 1980

[54] CARBONLESS RECORD SYSTEM

[75] Inventor: Hugh B. Skees, Dayton, Ohio

[73] Assignee: The Standard Register Company, Dayton, Ohio

[21] Appl. No.: 950,693

[22] Filed: Oct. 12, 1978

[51] Int. Cl.[3] ..... B41M 5/22

[52] U.S. Cl. ..... 282/27.5; 427/150; 427/151; 427/261; 427/288; 428/307; 428/327; 428/331; 428/530; 428/914

[58] Field of Search ..... 106/21, 31; 282/27.5; 427/150, 151, 261, 265, 288; 428/307, 488, 913, 914, 323, 327, 331, 530, 537

[56] References Cited

U.S. PATENT DOCUMENTS 4,063,754 12/1977 Shackle et al. ..... 428/914 X

*Primary Examiner*—Bruce H. Hess

*Attorney, Agent, or Firm*—Jacox & Meckstroth

[57] ABSTRACT

A pressure-responsive record transfer sheet for use against a receiving sheet which is chromogenically sensitized with a relatively colorless basic chromogenic dye-precursor. The transfer sheet is coated with a frangible transfer coating of plasticized resin or wax, having dispersed therein a solid acidic reactant, such as an acidic clay, which is insoluble in the liquid solvent but capable of reacting with the basic chromogenic dye-precursor to produce useful color when and where brought into reactive contact therewith, as by marking pressure applied to the transfer sheet. Intimate reactive contact for color production on the receiving sheet is achieved at the time and place of the pressure-induced transfer of the coating from the transfer sheet by dissolution of the dye-precursor on the receiving sheet in the transferred liquid solvent in contact with the transferred acidic reactant.

10 Claims, No Drawings

CARBONLESS RECORD SYSTEM

BACKGROUND OF THE INVENTION

In the art of record sheet material involving transfer and receiving sheets, the use of basic, colorless, organic, chromogenic dye-precursor materials and acidic color-developing reactants has long been known. Commonly the transfer sheet includes a pressure-rupturable coating of isolated droplets of a solution of the basic dye-precursor for use against a receiving sheet which bears a coating of solid acidic color-developing material which may or may not be soluble in the solvent of the basic dye-precursor solution. Typical constructions involve transfer sheets bearing a coating of microcapsules having pressure-releasable liquid cores of a basic dye-precursor, such as Crystal Violet Lactone, dissolved in an organic solvent such as polychlorinated biphenyl. The receiving sheet for use therewith is typically coated with an organic solvent-soluble acidic phenolic resin or an organic solvent-insoluble clay such as attapulgite.

Microencapsulation is an effective method of retaining the liquid droplets of dye-precursor solution, but it is an expensive procedure. Nonetheless it is the dominant commercial method.

Hot melt transfer coatings of basic chromogenic liquid dye-precursor solution droplets dispersed in solid resins have the advantage of economy, but have not met with commercial success because less effective droplet retention is achieved thereby. These hot melt transfer coatings of the art function very well when first made, producing excellent images on mated acidic receiving sheets. However, with the passage of time (of the order of days or weeks), two serious problems develop due to the leakage or migration of the liquid content of the coating: (a) discoloration of adjacent acidic surfaces, either on the acid-coated opposite face of the transfer sheet or on the acid-coated face of a mated receiving sheet, and (b) hardening of the waxy resin hot melt matrix so that transfer by applied marking pressure becomes difficult and inefficient. Much the more serious of these problems is the first, discoloration due to leakage during storage.

SUMMARY OF THE INVENTION

The instant invention provides a hot melt transfer sheet and coating, comprising a plasticized wax or resin having particles of solid insoluble acid reactant dispersed therein, which are completely devoid of the problem of discoloration during storage, and are greatly improved in the matter of hardening of the coating during storage.

The transfer sheets of this invention comprise a substrate sheet, such as paper or equivalent of plastics materials bearing on at least one surface thereof a hot melt coating which comprises:

(a) a solid resin, particularly a wax, (b) an organic liquid solvent of low volatility, which is capable of dissolving an organic, basic chromogenic dye-precursor, and (c) a solid, color-developing inorganic acidic reactant which is insoluble in the liquid solvent.

The solid acidic reactant is dispersed in particulate form in the solid plasticized waxy resin.

The transfer sheets of this invention function to produce a colored mark copy of pressure-mark indicia, on a mated chromogenically-sensitized receiving sheet, when and where writing, printing or typing pressure is applied to the face of the transfer sheet opposite the face which bears the inventive transfer coating. Said opposite face may be uncoated or coated with a substantially colorless, basic, chromogenic dye-precursor material for the purpose of making multiple copies throughout a stacked set of record sheets, as in a business form.

Eligible solid resins for the manufacture of the transfer coatings of this invention include various hydrocarbon resins, exemplified by the following products manufactured by Pennsylvania Industrial Chemical Corp.: vinyl toluene resins, called "Piccotex"; alkyl-aromatic resins, called "Piccovar"; and polyterpenes, called "Piccolytes". These resins are best used in combination with waxes and wax-like materials. Other useful resin wax combinations are combinations of cellulose derivatives such as hydroxy ethylcellulose with pentaerythritol tetrastearate or castor wax, combinations of ethylene-vinyl acetate copolymers with paraffin and microcrystalline waxes. In each case, the proportion of resinous material is preferably between 2 and 20 percent of the wax or wax-like material. Preferred waxes are hard microcrystalline waxes, such as hydrocarbon waxes and oxidized hydrocarbon waxes.

Eligible organic liquid solvents of low volatility include chlorinated aromatic and aliphatic hydrocarbons, lower-alkyl biphenyls such as mono-isopropylbiphenyl, and phthalic acid esters of fatty alcohols, particularly alcohols of 5–12 carbon atoms. Eligible solvents are judged of sufficiently low volatility if said solvents have a boiling point above about 150 degrees centigrade at 10 millimeters mercury and a vapor pressure below 20 millimeters of mercury at 100 degrees centigrade.

Eligible solid insoluble acid reactants include acidic clays such as attapulgite clay, Silton clay and acidic sepiolite clays. The acid reactant material may include in admixture kaolin clay which is generally not sufficiently reactive to be useful alone. Any acidic clay, including acid modified clays and clays modified with metallic ions, such zinc-modified clays are eligible for use herein, as long as the selected clay is a reactive color-developer with basic chromogenic dye-precursors and is not soluble in the selected liquid solvent. A modified clay can be selected by shaking the clay with the selected solvent to make a slurry, filtering the slurry, and adding the selected basic colorless, chromogenic dye-precursor material to the filtrate and the filter cake. The modified clay is eligible if no color forms in the filtrate, but does form on the solvent-wetted filter cake. The same test of eligibility can be used to select acid reactants other than clays, such as a particulate phenolic resin.

The receiving sheets eligible for use with the inventive transfer sheets are of the type which bear a coating of an organic, substantially or relatively colorless, chromogenic dye-precursor material. Exemplary of such chromogenic dye-precursor materials is Crystal Violet Lactone (CVL) or its equivalent, which may be present on the receiving sheet surface as a dry evaporate, as a low-tack ink or as a dispersion, particularly a solid dispersion, in a solid matrix material which is soluble in the liquid solvent of the inventive transfer sheet. One such eligible receiving sheet is the low-tack ink sheet of copending application, U.S. Ser. No. 854,829, filed Nov. 25, 1977 in the name of Theodore Maierson, which application is here incorporated by reference.

As the artisan will appreciate, the transfer coatings of this invention operate to avoid the well-known problem of discoloration by liquid leakage during storage by a two-fold mechanism. First, the liquid of the inventive transfer coatings is not a solvent for the acidic color-developing reactant coated therewith. Leakage or slow migration of the liquid to a sensitized chromogenic receiving surface causes no coloration. Second, the high surface area of the solid acid reactant helps greatly in preventing any inadvertent and undesired migration of the liquid during storage. This latter aspect is also instrumental in preventing loss of plasticity, or hardening, of the coating during storage, thus making the inventive transfer coatings easily and efficiently transferable under marking pressure even after prolonged aging. The inventive combination of solid resin, liquid solvent of low volatility and solid particulate acid reactant is remarkably stable to aging and its attendant problems. The liquid solvent in the transfer coatings of this invention is not prone to migration to any detrimental degree, and, in any event, does not cause discoloration of the record material by such migration.

The record sheets and transfer coatings of this invention may be further understood through the following specific examples. Throughout this disclosure, all parts and percentages are by weight.

EXAMPLE 1

The following composition was applied to paper sheets as a hot melt:

| Component | Parts |
|---|---|
| Wax: Mekon white | 9.4 |
| M & M 7525 | 5.6 |
| Liquid Solvent: Santicizer/711 | 47.2 |
| Acid Reactant: Silton Clay | 37.7 |

Mekon White is a hard microcrystalline-hydrocarbon wax of penetration 3 to 5, sold by Western Petrochemical Company.

M & M 7525 is a chemically modified hydrocarbon wax produced by air oxidation, followed by reaction with a diisocyanate, sold by the Moore and Munger Company.

Santicizer 711 is a proprietary product sold by Monsanto Chemical Company, consisting of mixed esters of phthalic acid and $C_7$, $C_9$, and $C_{11}$ alkyl alcohols.

Silton Clay is a proprietary acid-treated clay sold in the United States by Mitsubishi International Corporation.

The liquid solvent and the acid reactant were dispersed by intense agitation in a melt of the wax. The hot melt dispersion was coated by a roll-coating process onto paper sheets at a rate of 2.0 to 2.5 pounds per 500 sheet ream, the sheets in the ream being 20 inches by 30 inches.

EXAMPLE 2

By the procedure of Example 1, the following composition was prepared as a hot melt dispersion and coated onto paper:

| Component | Parts |
|---|---|
| Wax: C-7500 | 13 |
| M & M 7525 | 8 |
| Liquid Solvent: LM-344 | 50 |
| Acid Reactant: Imvite FGS | 35 |

C-7500 is an oxidized Fisher Tropsch wax with melting point 200°–215° F., acid number 10–15 and saponification number 25–35. C-7500 wax is sold by Bareco Division of Petrolite Corporation of St. Louis, Missouri.

LM-344 is a proprietary product sold by Keil Chemical Co., consisting of chlorinated hydrocarbons of 40% chlorine.

Imvite FGS is a proprietary sepiolite clay sold by Moore and Munger Corporation.

EXAMPLE 3

The transfer sheets of Examples 1 and 2 were mated with receiving sheets, containing CVL, with the reactive faces together. Typing and Stylus writing on the upper un-coated face of the transfer sheets produced a dark blue mark, corresponding to the type and stylus marks, on the face of the receiving sheets. Storage of the mated sheets for five months at normal room temperatures produced no leakage discoloration of the receiving sheets. The stored sheets still readily produced copies of stylus-and type-produced indicia on the receiving sheets, as when freshly made. Similar or improved results were obtained against the low-tack ink receiving sheets disclosed in Maierson Patent Application Ser. No. 854,829, incorporated above.

Other basic, chromogenic, dye-precursor materials, may be substituted for the CVL in the above examples. Typical of these other dye-precursors are the fluorans, such as, diethylamino-3-diethylamino fluoran mentioned in U.S. Pat. No. 3,514,310; the spiro-syrans, such as 3-methylspiro-dinaphthopyran, mentioned in U.S. Pat. No. 3,293,060; the thiazines, such as benzoyl-leuco-methoylene blue; and indole substituted pyromellitides, such as 3,5-bis(p-diethylaminophenyl)-3,5-bis(1,2-dimethylindole-3-yl)pyromellitide. As the artisan will appreciate, the chromogenically sensitized receiving sheets which are eligible for use with the transfer sheets of this invention are preferably colorless or substantially so, although they need be only relatively colorless, that is relative to the color produced by the acid reactant of the transfer sheets. For instance, a yellow or light blue receiving sheet is relatively colorless, compared to the dark blue to black indicia which may be produced by reactive contact with the inventive transfer sheets, and are therefore useful therewith.

The invention having thus been described, the following is claimed:

1. A pressure-responsive record transfer sheet comprising:

a substrate sheet and a coating on at least one surface of the substrate sheet, wherein the coating is an acidic reactant transfer coating capable of producing useful color when and where brought into intimate reactive contact with an organic, relatively colorless, chromogenic, dye-precursor, and wherein the coating comprises a solid, frangible resin, an organic liquid dye-precursor solvent of low volatility having a boiling point above about 150 degrees centigrade at 10 millimeters of mercury and a vapor pressure below 20 millimeters of mercury at 100 degrees centigrade, and a solid particulate inorganic acidic reactant, wherein the solid acidic reactant is dispersed in a heated mixture of resin and liquid solvent, and wherein the solid acidic reactant is insoluble in the liquid solvent.

2. The pressure-responsive record transfer sheet of claim 1, wherein the resin is a wax, the liquid solvent is selected from the group consisting of chlorinated aliphatic hydrocarbons, lower alkyl biphenyls and phthalic acid esters of fatty alcohols, and the acidic reactant is a clay.

3. The pressure-responsive record transfer sheet of claim 1, wherein the coating consists essentially of 10–25% resin, 40–60% solvent and 30–45% acidic reactant.

4. The pressure-responsive record transfer sheet of claim 3, wherein the coating consists essentially of 14–22% wax, 45–55% solvent and 33–40% clay.

5. The pressure-responsive record transfer sheet of claim 4, wherein the substrate sheet is paper.

6. A method of making a mark on a basic dye-precursor chromogenically-sensitized record receiving sheet comprising the steps of:

(a) superimposing a coated pressure-responsive transfer sheet on the chromogenically-sensitized record sheet with the pressure-responsive coated face next to a chromogenically-sensitized face of the record receiving sheet, and (b) applying marking pressure to the upper face of the coated pressure-responsive transfer sheet so as to transfer at least a part of the coating from the pressure-responsive transfer sheet to the chromogenically-sensitized face of the record receiving sheet for reactive development of useful color on the chromogenically-sensitized face of the record receiving sheet when and where marking pressure was applied, wherein the coated pressure-responsive transfer sheet comprises a substrate sheet and a coating on at least one surface thereof, and wherein the coating comprises a solid frangible resin, an organic liquid dye-precursor solvent of low volatility having a boiling point above about 150 degrees centigrade at 10 millimeters of mercury and a vapor pressure below 20 millimeters of mercury at 100 degrees centigrade, and a solid inorganic acidic reactant wherein the solid acid reactant is dispersed in a heated mixture of the resin and the liquid solvent, and therein the solid acid reactant is insoluble in the liquid solvent.

7. The method of claim 6, wherein the resin is a wax, the liquid solvent is selected from the group consisting of chlorinated aliphatic hydrocarbons, lower alkyl biphenyls and phthalic acid esters of fatty alcohols, and the acidic reactant is a clay.

8. The method of claim 6, wherein the coating consists essentially of 10–25% resin, 40–60% solvent and 30–45% acidic reactant.

9. The method of claim 8, wherein the coating consists essentially of 14–22% wax, 45–55% solvent and 33–40% clay.

10. The method of claim 9, wherein the substrate sheet is paper.

* * * * *